United States Patent [19]

Queneau et al.

[11] 4,236,915

[45] Dec. 2, 1980

[54] PROCESS FOR OXYGEN SPRINKLE SMELTING OF SULFIDE CONCENTRATES

[76] Inventors: Paul E. Queneau, Cornish, N.H. 03746; Reinhardt Schuhmann, Jr., 1206 Hayes St., West LaFayette, Ind. 47906

[21] Appl. No.: 971,995

[22] Filed: Dec. 21, 1978

[51] Int. Cl.[3] ..... C22B 15/04

[52] U.S. Cl. ..... 75/74; 75/23; 75/26; 75/82; 75/92

[58] Field of Search ..... 75/74, 72, 76, 82, 92, 75/23, 26

[56] References Cited

U.S. PATENT DOCUMENTS 4,147,535 4/1979 Lilja et al. ..... 75/74

*Primary Examiner*—R. Dean

*Attorney, Agent, or Firm*—Parmelee, Miller, Welsh & Kratz

[57] ABSTRACT

Method for producing a metal matte from a nonferrous metal containing sulfide concentrate in a reverberatory type furnace by sprinkling a mixture of sulfide concentrates, flux and an oxygen-rich gas as a plurality of paraboloidal suspensions into a hot sulfur dioxide-rich atmosphere above the slag phase of the furnace charge. By introducing the concentrate, flux and oxygen-rich gas in such a manner, oxidation of the sulfide is effected prior to contact with the slag phase and substantially uniform heat and mass distribution are present throughout a major portion of the furnace. Coal is optionally introduced in a homogeneous mixture with the concentrate if nonautogenous operation is desired or slag cleaning is carried out to produce a discardable slag.

14 Claims, 2 Drawing Figures

PROCESS FOR OXYGEN SPRINKLE SMELTING OF SULFIDE CONCENTRATES

BACKGROUND OF THE INVENTION

The use of the reverberatory furnace for the smelting of nonferrous metal sulfides to a nonferrous matte, the matte subsequently being converted and refined to recover the valuable nonferrous metal therefrom, has been one of the primary means for the recovery of metals such as copper, nickel and the like. Numerous such plants for the production of those nonferrous metals are in existence and operation, although recent developments with respect to energy and the environment have created problems relative to use of reverberatory furnaces.

Such reverberatory furnaces are horizontal vessels having a refractory lining, and burners at one end, with the internal width of such a vessel being about twenty-five to thirty-five feet, the internal length being generally about one hundred feet, and a heighth between the hearth and roof thereof of between about ten and fifteen feet. Roof construction varies but is commonly of suspended basic or sprung silica design. The furnace is fossil fuel-fired through burners at one end, although various placements of such burners throughout the furnace may be used, the burners combusting oil, natural gas or pulverized coal to heat a charge of material within the furnace and effect smelting of the sulfides to matte. Exhaust gases are normally discharged at the end of the furnace opposite the burner end. The furnace design generally provides for slag tap-holes, at or near the end of the furnace opposite the burners; while the matte tap-holes are variously located. Charging of sulfide concentrate and flux to the furnace is usually accomplished by side feeding along the furnace walls.

Reverberatory furnaces, as known in the art and as employed worldwide, are wasteful consumers of fossil fuels and, in addition, harm the environment. Such furnaces, as typified in the smelting of raw copper sulfide concentrates, suffer from serious inefficiency in heat transfer and as a chemical reactor. The same holds true even if the furnace feed is hot roaster calcine rather than wet filter cake. These furnaces must be supplied with large quantities of natural gas, oil or coal, which have now greatly increased in cost, and may be in short supply or better used for higher priority requirements.

The dusty off-gases from conventional reverberatory furnaces are high in volume and low in sulfur dioxide content, e.g., one percent. The former results in high cost of dust recovery while the sulfur dioxide content is too low for economical sulfur fixation, yet too high for environmental acceptance as discharge to the atmosphere. The cost of dust recovery is directly related to the gas volume requiring treatment. Also, a feed stock of at least about four percent sulfur dioxide is required for efficient operation of a sulfuric acid plant, and much preferably eight percent, for reasons of economy. Alternative sulfur fixation means require even richer sulfur dioxide feed streams for economic viability.

The process fuel efficiency of conventional reverberatory furnace operation is low, primarily because gas-solid contact is poor and hence the rate of heat exchange between the hot gases and the charge fed down the side walls of the furnace is low. As a result, as much as half of the fuel's heat content escapes in the furnace exhaust gas. Chemical reaction efficiency is low because not only gassolid contact but gas-liquid and liquid-liquid contact are also poor. The heat and mass transfer characteristics of the reverberatory furnace are poor because the active surface to mass ratio of the furnace input components is small. Thus, furnace performance is sluggish. It wastes energy in all its forms, in addition to its adverse impact on the environment.

In view of the high cost of replacing reverberatory furnaces with apparatus and processes of more advanced design, many studies and experiments have been carried out both by industry and by government in search of improvements in reverberatory furnace practice to decrease air pollution, especially $SO_2$ emission, to conserve fossil fuel, and to improve metallurgical efficiency. One alternative which has been extensively investigated, but with generally unfavorable outcomes, is flue gas scrubbing, e.g., using lime slurries to remove $SO_2$ in the form of a calcium sulfate sludge. Another costly approach to treatment of reverberatory furnace gases is to first concentrate its $SO_2$ content by absorption in an organic solvent, followed by fixation of the concentrated $SO_2$ as elemental sulfur, sulfuric acid, or liquid $SO_2$. Because the bulk of the volume of reverberatory flue gas is fossil fuel combustion products, including the nitrogen from the air supplied for combustion, substitution of commercial oxygen for part of the air supplied to the reverberatory furnace burners for fossil fuel combustion has been adopted in some installations increasing fuel efficiency and permitting higher smelting throughput ratio. Lancing of oxygen through the roof of reverberatory furnaces, to increase smelting capacity and $SO_2$ content of off-gas while reducing fuel consumption, has also been examined but has not achieved commercial success. Problems which can be encountered include damage to the refractories by excessive localized heating and splashing of the bath. Lances can be employed to obtain good gas-liquid-solid contact in rotary converters by creating a turbulent bath. This was disclosed by one of the present inventors in U.S. Pat. Nos. 3,004,846; 3,030,201; 3,069,254; 3,468,629; 3,516,818; 3,605,361 and 3,615,362. However, use of lances to adapt the turbulent bath principle to reverberatory furnaces is not practical. Summarizing the above discussed and other previously proposed modifications of existing reverberatory furnaces and auxiliary processes, none have gained wide acceptance and none seem capable of postponing the abandonment of most of these furnaces.

Advanced technology for the treatment of nonferrous sulfide concentrates involves complete abandonment of the reverberatory furnace for smelting purposes along with some or all of the ancillary equipment. Examples are the new Noranda and Mitsubishi continuous smelting processes. A recent development by the present inventors is the Q-S Oxygen Process for continuous, autogenous conversion of nonferrous metal sulfides to matte or metal as described in U.S. Pat. No. 3,941,587, wherein autogenous conversion is effected in a single reactor with introduction of oxygen effected above and beneath the molten bath.

Two flash smelting processes, i.e., the INCO oxygen flash smelting process and the Outukumpu Oy process, are well established alternatives to the conventional reverberatory furnace process and employ furnaces of special design. In INCO oxygen flash smelting, as disclosed by one of the applicants herein, in U.S. Pat. NO. 2,668,107, the sulfide-flux-oxygen mixture is injected into a reverberatory type furnace, of special volume enclosed in an impermeable steel casing, through horizontally disposed end burners. These burners which are similar to conventional pulverized coal burners, inject the dry solid charge with oxygen as a jet-like stream.

In conventional practice, reverberatory furnaces are the primary smelting apparatus for nonferrous mineral concentrates. The substitution of an advanced technological process may be difficult for economic reasons. Nevertheless, the continued use of such reverberatory furnaces, as hereinbefore described, had taken on grave disadvantages in respect to both energy and environmental conservation.

An object of the present invention is to provide a process for application in existing reverberatory furnaces and which overcomes several of the drawbacks currently associated with their use.

Another object is to provide a process that enables the use of existing reverberatory furnaces, with relatively simple and inexpensive alterations and additions, to smelt nonferrous mineral sulfides to matte, at greatly increased throughput rates, accompanied by greatly decreased fuel rates and greatly increased sulfur dioxide content of the furnace exhaust gas.

A further object of the present invention is to provide a method whereby tonnage oxygen can be skillfully employed so as to allow ready replacement of standard, obsolete reverberatory furnace practice by a relatively efficient and economic smelting procedure. In fact, Examples IV and V hereinafter indicate that the process of the present invention is competitive with the two flash smelting processes now in commercial use. This invention permits postponement of the heavy capital expenditures otherwise required for total plant replacement so as to comply with government energy and environmental conservation regulations.

It is an additional object of the present invention to provide a process for smelting of nonferrous mineral sulfides whereby pulverized coal may be judiciously employed in minor quantities to effectively control the value metal content of both matte and slag output.

BRIEF SUMMARY OF THE INVENTION

A method for producing a matte containing at least one nonferrous metal of the group comprising copper, nickel and cobalt, from metal-containing sulfide concentrates in a horizontal reverberatory type furnace containing a molten charge of matte and slag and a heated atmosphere rich in sulfur dioxide comprises injecting a mixture of the metal-containing sulfide, flux, and an oxygen-rich gas into the heated atmosphere, with a major portion of the mixture being injected downward through vertically disposed burners as a gentle extensive rain such that oxidation of the sulfide concentrates is substantially effected prior to contact thereof with the molten charge and substantially uniform heat and mass distribution are effected over a major portion of the furnace. Normally, the oxygen-rich gas contains 33–99.5% oxygen and the vertically disposed sprinkler burners inject the dry solid charge radially downward into the hot atmosphere of the furnace as a diffuse suspension resulting from the horizontal spreading velocity of the feed upon injection. The latter is preferably greater than the vertical axial velocity so as to insure that the injected solids rain down gently and extensively upon the molten bath. In a further embodiment, varying amounts of fine coal particles may be thoroughly admixed with the sulfide concentrate and flux and injected therewith along with the oxygen-rich gas, for control of matte grade. Injection of a sulfide concentrate and coal homogenous mixture optionally can be made only at a position towards the slag discharge end of the furnace, whereby the value metal content of the slag is sufficiently decreased so that the same may be discarded.

DETAILED DESCRIPTION

Figure 1:
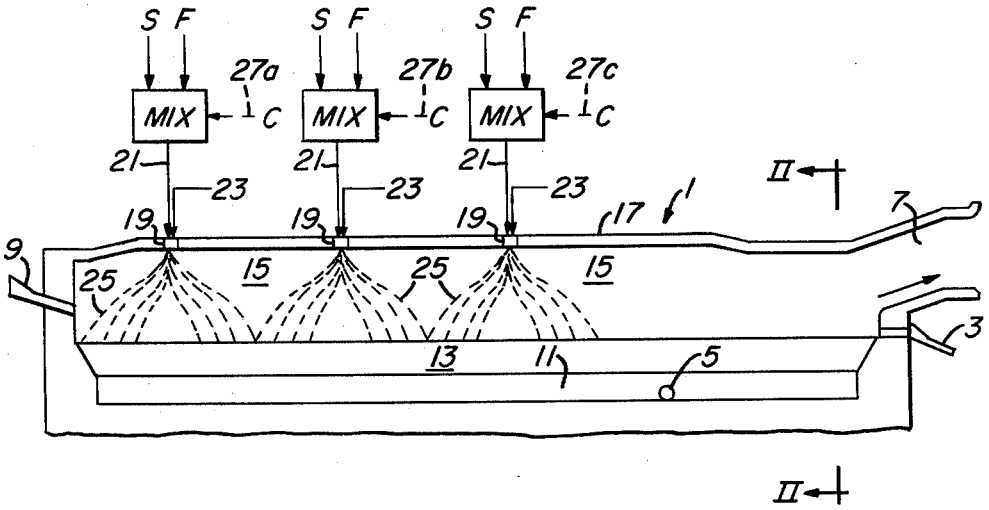
FIG. 1 is a schematic illustration of a crosssection of a reverberatory furnace modified for use of the present process.
Figure 2:
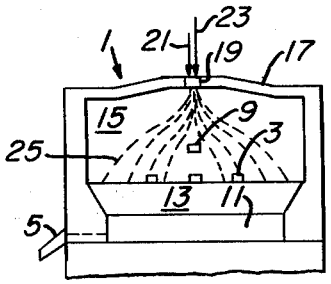
FIG. 2 is a view taken along the lines II—II of FIG. 1.

In the present method, nonferrous metal sulfides are converted to value metal mattes in a modified reverberatory furnace. The process is especially useful in the conversion of copper, nickel and cobaltiferous sulfide concentrates to high grade matte, such as concentrates rich in chalcopyrite, pentlandite, linnaeite, pyrite and pyrrhotite. The following description will relate to copper concentrates, although mixtures of copper, nickel or cobaltiferous sulfide concentrates with other nonferrous metals may also be processed according to the described process and are intended to be included herein.

The copper concentrates and flux are provided in a dry, finely divided, well mixed physical state, so as to enable them to be sprinkled as a gentle rain of fine liquid particles over the molten charge within a reverberatory furnace. The sulfides should be preferably of a particle size less than about 65 mesh, to provide for satisfactory reaction of the sulfide particles with oxygen in the gaseous phase above the molten charge within the furnace prior to contact of the particles with said molten charge. The particle size of the flux should most preferably be less than about 35 mesh for similar reasons, e.g., heat and mass transfer.

The injection of the sulfide concentrate material into the furnace is done in conjunction with oxygen-rich gas, the oxygen content of which effects the conversion of the sulfides. The term "oxygen-rich gas" is used herein to define gases which contain 33% or more oxygen, up to and including commercial oxygen which contains about 95–99.5% oxygen content. Preferably, a gas having an oxygen content of between about 80–99.5% oxygen is used for smelting, which preferred range provides the most efficient operation of the process.

The sulfide concentrate, flux, and the oxygen-rich gas are injected into the reverberatory furnace in such manner as to form diffuse, low velocity paraboloidal suspensions of mineral particles, by sprinkling of the solid material from the roof of the furnace so that the reaction of the sulfide material with the oxygen is satisfactorily completed in the "fireball" before the sulfide material becomes a part of the liquid bath within the furnace. Thus gas-solid contact of the oxygen and the sulfides is effected in the gaseous phase above the slag phase in the reverberatory furnace with the resultant exothermic chemical reactions taking place providing, where desired, for autogenous operation of the process.

In order to effect the substantially complete reaction of the sulfide concentrates with the oxygen prior to contact thereof with the liquid bath, and to effect substantially uniform temperatures and mass distribution over the furnace, the sulfide concentrates are injected into the hot atmosphere at a plurality of locations along the roof of the furnace. These vertically directed injections may be effected through use of a plurality of vertically disposed burners in the roof of the furnace which inject the sulfide concentrates in such manner as to form substantially paraboloidal suspensions. The solids are injected into the hot sulfur dioxide-rich atmosphere so as to sprinkle them as discrete particles of dry concentrates and flux in a uniform manner over a major area of the furnace bath, with resultant uniformity of temperature and mass distribution. The horizontal spreading velocity of the feed upon injection is preferably greater than the vertical axial velocity, even though the latter may exceed 100 feet per second, so as to insure that the injected solids rain down gently and extensively upon the molten bath. The term "sulfur dioxide-rich" atmosphere is used herein to designate an atmosphere having greater than about 10% by volume of sulfur dioxide.

With such injection of the concentrates in an oxygen-rich gas, the kinetics of the smelting are greatly enhanced by the high oxygen concentration of the gas surrounding the individual particles of the sulfide concentrate. It is also sharply enhanced by the large surface area of intimate contact between the liquid reactants immediately upon entering the bath. Such injection also provides excellent slag-matte dispersion with good heat control, while the entire molten charge is kept in a calm condition, so as to promote settling of the matte phase through the slag phase.

A highly beneficial effect of such sprinkling of the concentrates as an intimate, uniform, paraboloid mixture of concentrate, flux, and oxygen-rich gas, is that desired reactions take place within the heated atmosphere above the slag, and the several burners sprinkle a pattern of substantially contiguous large area ovals along the long axis of the furnace as the melted products contact the slag.

The temperature of the material within the furnace, prior to introduction of the sulfide concentrate, flux and oxygen-rich gas, should be above 2000° F. so that spontaneous reaction of the concentrates and oxygen will be effected.

One embodiment of the present invention provides for admixture of pulverized coal with the mineral concentrate and injection of that mixture with an oxygen-rich gas. Because of infiltration of air into reverberatory type furnaces and the loss of heat to the surroundings such as by convection, conduction or radiation, the heat supplied by oxidation of mineral concentrates is, at times, less than that which would be lost. For example, the process may be carried out under conditions which produce a copper matte having a lower than optimum copper content, insofar as the exothermic reaction will not supply sufficient heat to offset the heat losses and provide for autogenous operation, even where commercial oxygen is used. In such a situation, a minor amount of coal may be admixed with the mineral concentrates, for the purpose of supplying heat to the contents of the furnace by combustion therein and offsetting heat losses that may occur to provide balanced operation.

In another embodiment of the present invention, such coal addition may be made only to the burner located closest to the slag discharge end of the furnace, e.g., at a position about halfway between the end walls. In such an operation, the dry charge sprinkled into the heated atmosphere may exclude flux material and can comprise a mixture of sulfide concentrate, e.g., chalcopyrite or pyrite with a minor amount of coal, while the oxygen-rich gas, rather than the preferred 80–99.5% oxygen, may comprise oxygen-enriched air, e.g., 33% $O_2$. Under appropriate conditions, copper, nickel, cobalt or iron sulfide concentrates are melted by the heat of coal combustion, with consequent vaporization of their labile sulfur atoms. The resulting liquid matte, rich in iron sulfide and poor in copper, nickel or cobalt, is sprinkled over a large area of slag near the central third of the furnace. This steady rain of liquid low grade matte thus has ample contact and time to lower the value metal content of the slag prior to its discharge from the furnace by the combined chemical, dilution and coalescing washing effects of the percolating ferrous sulfide. With the calm bath provided by operation of the present process, diffusional mass transfer occurring across the relatively small area of the horizontal plane separating the bath silicate and sulfide phases is not significant. Consequently, equilibrium conditions between these two phases are not approached; and the process used in the furnace with such coal addition substantially increases value metal recovery, e.g., produces a high copper matte together with a low copper slag, even without the preferred countercurrent flow of such phases. The production of such a low-copper slag enables the direct discarding of the same, thus dispensing with the need for costly and energy intensive slag treatment for recovery of copper therefrom.

In the drawings, which are schematic representations of the reverberatory furnace modified so as to be used in carrying out the present process, a reverberatory furnace 1 is illustrated, conventionally built with refractory material, which has a slag outlet 3, a matte outlet 5, and an exhaust gas outlet 7. A charging means 9 may be present for return of converter slag to the furnace for recovery of value metals therein.

The furnace has in the lower portion thereof molten material comprising a layer of molten matte 11 and a layer of molten slag 13 over the matte. A heated sulfur dioxide-rich atmosphere is present in the area 15 between the slag phase 13 and the roof 17 of the furnace. Disposed along the roof 17 of the furnace are a plurality of oxygen sprinkle burners 19 for generation of paraboloid suspensions of sulfide concentrate, flux, and oxygen-rich gas in the heated atmosphere of the furnace.

Homogeneous mixtures of sulfide (S) concentrate and flux (F) are charged, by means of lines 21, mixed with an oxygen-rich gas fed through lines 23 through the burners 19 and into the hot atmosphere above the molten slag 13. Coal (C) is added, whereby desired, in intimate admixture with the concentrate and charged along with the oxygen to the furnace by means of the burners 19.

As illustrated, the sulfide concentrate, flux, and oxygen-rich gas form a plurality of paraboloid suspensions 25. These radially downwardly flowing suspensions 25 of sulfide concentrate, flux, and oxygen-rich gas enable interaction of the concentrate, flux and oxygen within the hot atmosphere in the area 15 of the furnace such that the desired heat transfer and chemical reaction are satisfactorily completed prior to contact with the slag 13. As illustrated, it is preferred that the suspensions be of such shape that when the material contained therein rains on the slag, a pattern of contiguous or overlapping ovals is formed thereon.

Where coal is to be added to the mineral sulfide to provide additional heat in the furnace, the coal is introduced through lines **27*a*, 27*b* and 27*c* and intimately admixed therewith to form a homogeneous mixture prior to injection through burners 19. In the embodiment wherein the coal is to be added only through the burner 19 closest the slag discharge end of the furnace, the coal is introduced through line 27c and admixed with the mineral sulfide concentrate and injected only through the burner 19 closest to the slag outlet 3 of the furnace 1**.

The invention is further illustrated by reference to the following examples, wherein Example I refers to conventional reverberatory smelting practice and the subsequent examples to embodiments of the present invention.

EXAMPLE I

Conventional Reverberatory Process

As an example of conventional reverberatory furnace operation for the smelting of copper sulfides, attention is drawn to the publication "Energy Use in Sulfide Smelting of Copper" by H. H. Kellogg and J. M. Henderson, Chapter 19, Vol. 1, Extractive Metallurgy of Copper, Metallurgical Society of AIME, 1976, and particularly to pages 373–375 and to the Process Fuel Equivalent (PFE) table at page 397. As reported therein, a typical wet-charge reverberatory furnace operation for smelting of copper concentrates is described where 1040 dry tons of copper concentrate are treated per day, the concentrate analyzing 29.5% copper, 26% iron, 31% sulfur and 8% silica. Furnace heat loss rate by conduction, convection and radiation to the surroundings is 518,000 Btu per minute. The copper content of the matte produced is 35%, and that of the slag is 0.46%. Furnace off-gas produced contains about 1% $SO_2$ by volume.

The Process Fuel Equivalent for such an operation is given in the following Table I:

concentrate per day, and even assuming the use of sufficient commercial oxygen to smelt the concentrate to 75% copper matte (i.e. to oxidize nearly all of the iron sulfides in the original concentrate), the heat input from the exothermic smelting reactions would not supply the sensible heat in the smelting products and at the same time supply the heat loss and infiltration air thermal requirements, so that a substantial increase in smelting rate is achieved and, in fact, required. Fluid flow estimates based on a conventional suspended basic roof reverberatory furnace design but with the end burner, charge and other undesired openings sealed off, indicate that 10,000 standard cubic feet per minute of air may be drawn into the furnace to prevent leakage of sulfur dioxide into the ambient atmosphere. Much of this air's oxygen content, e.g., 75%, will participate in the smelting reactions and thus will serve to reduce the consumption of commercial oxygen. However, the excess oxygen and all the nitrogen, totaling about 8,425 standard cubic feet per minute, must be heated to smelting temperature and this requirement accounts for a heat output item of substantially 400,000 Btu per minute. Thus, at the above described reverberatory smelting rate, the combined requirement to cover furnace heat loss and heating of infiltrative air amounts to 635 Btu per pound of concentrate, which requirement dictates that the smelting rate be increased for autogenous oxygen sprinkle smelting in this conventional reverberatory furnace.

In the present process, wherein an intimate mixture of copper concentrates, flux and oxygen-rich gas are injected into the hot atmosphere of a reverberatory type furnace, using a plurality of vertically disposed burners of such design that paraboloidal suspensions are produced, and substantially uniform heat and mass distribu-

TABLE I

PFE for Wet-Charge Reverberatory Smelting

| | | | |
|---|---|---|---|
| Smelting Rate: | 1040 tons conc./day | Air Preheat: | 72% to 428° F. (220° C.) |
| Fuel Rate: | $4.81 \times 10^6$ Btu/ton conc. | 98% Oxygen Used: | none |
| Matte Grate: | 35% Cu | Tons Acid Rec./ton anode: | 2.287 |
| OUE: | 90% | Tons conc./ton anode: | 3.440 |

| Item | Per Ion Anode Copper | | |
|---|---|---|---|
| | Amount | Unit Energy | $10^6$ Btu |
| 1. Smelting: | | | |
| (a) Fuel oil | 112.2 gal | 147.400 Btu/gas | 16.540 |
| (b) Compress combustion air (0.6 psig.) | 144,100 SCF | 0.63 Btu/SCF | 0.091 |
| (c) Steam to preheat combustion air | — | — | 1.303 |
| (d) Steam to preheat fuel oil | — | — | 0.079 |
| (e) Steam to atomize fuel oil | — | — | 0.304 |
| (f) Gas handling & dust collection | 230,200 SCF | 2.52 Btu/SCF | 0.580 |
| (g) Flux for smelting | 0.041 tons | 100,000 Btu/ton | 0.004 |
| (h) Steam credit: | | | |
| (1) used for c, d, e | — | — | −1.686 |
| (2) power generated | 427.6 kwh | 10,500 Btu/kwh | −4,490 |
| 2. Converting: | | | |
| (a) Total energy input | 1.042 ton blister | $3.273 \times 10^6$ Btu/ton | 3.410 |
| (b) Steam credit as power | 171.1 kwh | 10,500 Btu/kwh | −1.797 |
| 3. Anode Production | 1.0 ton | $1.34 \times 10^6$ Btu/ton | 1.346 |
| 4. Miscellaneous (material handling & utility) | 48.2 kwh | 10,500 Btu/kwh | 0.506 |
| 5. Acid Mfg.: | | | |
| (a) Converter gas (7.62% $SO_2$) | 216.6 kwh | " | 2.275 |
| (b) Reverberatory gas to atmosphere | | | |
| | | TOTAL | 18.465 |

PFE = $18.465 \times 10^6$ Btu/ton anode copper
= $5.129 \times 10^6$ Kcal/tonne anode copper

EXAMPLE II

If the present claimed process were to be used for smelting of the copper concentrate described in Example I using the same throughput of 1040 tons of copper tion are effected over a major portion of the furnace, the conversion of the reverberatory process to the autogenous mode of the present process requires an important increase in the smelting rate. The rate that is assumed for the purposes of this example is a rate of 2,000 tons of concentrate per day. At this smelting rate, but with the heat loss and air infiltration rates the same as those above described, the heat requirement to compensate for these two factors becomes 330 Btu per pound of concentrate, instead of 635 Btu per pound of concentrate. Due to the infiltrated air, the furnace atmosphere contains sufficient excess oxygen to oxidize suspended dust in its passage through the settling zone. This is beneficial since such oxidation decreases the dust's sulfur content and increases its melting point. Any elemental sulfur present is oxidized to sulfur dioxide.

Using a smelting rate of 2,000 tons of concentrate per day in the present process, a series of trial heat balances with varying input of commercial oxygen and in the production of a varying grade of copper content of the matte product, would provide the results listed in Table II:

TABLE II

Heat Balances for Autogenous Oxygen Sprinkle Smelting 2000 tons concentrate per day
Concentrate Analysis: 29.5% Cu, 26.0% Fe, 31.0% S, 8.0% $SiO_2$
Slag Analysis: 37.1% Fe, 38.3% $SiO_2$
Barren Flux: 81.5% $SiO_2$
Slag and Matte at 2200° F.; Flue gases at 2300° F.
Air Infiltration: 10,000 scfm

| | | | | |
|---|---|---|---|---|
| Matte grade (% Cu) | 55 | 60 | 65 | 70 |
| 98% $O_2$, lb/lb concentrate | 0.18 | 0.20 | 0.22 | 0.25 |
| $SO_2$ in flue gas (volume %) | 38 | 40 | 42 | 44 |
| Heat Output, Btu/lb concentrate | | | | |
| 1. Sensible heat in gas | 301 | 315 | 328 | 343 |
| 2. Sensible heat in matte | 204 | 179 | 155 | 136 |
| 3. Sensible heat in slag | 265 | 313 | 360 | 392 |
| 4. Heat loss to surroundings | 186 | 186 | 186 | 186 |
| Totals | 956 | 993 | 1029 | 1057 |
| Heat input, Btu/lb concentrate | | | | |
| 1. Oxidation of iron sulfides | 842 | 949 | 1046 | 1122 |
| Heat deficiency, Btu/lb concentrate | | | | |
| | 114 | 44 | −17 | −65 |

As is illustrated in Table II, the process is thermally balanced and autogenous for production of a matte grade of about 64% copper, which corresponds to a feed of 0.22 pounds commercial oxygen (98%) per pound of concentrate. Also, at such operating conditions (64% Cu matte), the exhaust gas from the furnace will contain about 42% sulfur dioxide and will be exhausted at a rate of about 16,000 standard cubic feet per minute. The latter is one-third of the gas volume in a conventional fossil fuel-fired reverberatory furnace operation, even when such conventional operation is operating at about one-half the smelting rate of the present process. Another important feature of the present process, indicated in Table II, is that thermal control of the process can be easily achieved by control of the input of concentrate and commercial oxygen. Whereas conventional reverberatory processing is thermally sluggish, the present process is thermally responsive.

EXAMPLE III

The present process is also adaptable to smelting of sulfide concentrates wherein a mixture of the concentrates and a minor amount of coal is fed with the oxygen-rich gas, so as to extend the range of operating conditions. A copper concentrate, of the composition used in Table II, is treated at a smelting rate of 1,500 tons per day of concentrate, to produce a 50% Cu matte, with the slag analysis, barren flux and air infiltration as shown in Table II. Using 98% oxygen, at a rate of 0.2 lb/lb of concentrate, and adding to the concentrate 45 tons of coal per day (0.03 lb/lb concentrate; coal of 65% C, 5% H and a heating value of 12,000 Btu/lb), the heat balance illustrated in Table III is achieved:

TABLE III

| | |
|---|---|
| Heat output, Btu/lb concentrate | |
| 1. Sensible heat in gas | 387 |
| 2. Sensible heat in matte | 234 |
| 3. Sensible heat in slag | 208 |
| 4. Heat loss to surroundings | 249 |
| Total | 1078 |
| Heat input, Btu/lb concentrate | |
| 1. Oxidation of iron sulfides | 723 |
| 2. Combustion of Coal | 355 |
| Total | 1078 |

For these conditions, the oxidation of iron sulfides provides a heat input deficient by over 300 Btu per pound of concentrate as compared to the required heat output. However, a thermally balanced operation is achieved by addition of only 3% coal, based upon the weight of the concentrate, such addition corresponding to 0.72 million Btu per ton of concentrate. The oxygen consumption per pound of concentrate remains slightly below that for autogenous smelting of 2,000 tons per day to a 64% copper matte (Table II), while the $SO_2$ content of the effluent gas is about 26%, well within the range required for efficient and economic acid manufacture.

Two further examples are made using the following constants, where applicable, to evidence efficient operation of the present oxygen sprinkle smelting process:

CONSTANTS

Concentrate analysis (dried)=29.5% Cu; 26.0% Fe; 31% S; 8% $SiO_2$; and 0.1% $H_2O$
Slag Composition: 0.46% Cu, 37.1% Fe, 38.3% $SiO_2$
Temperatures: Slag and Matte=2200° F.; Flue Gas=2300° F.
Flux analysis (dried)=82% $SiO_2$ and 0.1% $H_2O$
Temperature of all materials charged: 77° F.
Commercial Oxygen=98% $O_2$ (100% reacts)
Oxygen-Enriched Air=33% $O_2$ (mixture of 16%—98% $O_2$ and 84% air) (all $O_2$ reacts)
Heat Loss Rate=518,000 Btu/minute
Air Infiltration Rate=10,000 scfm (75% of oxygen in infiltrated air reacts)
Standard Temperature and Pressure Conditions of 32° F. and 1 atm.
Coal Analysis=60% C; 5% $H_2$ heating value of 12,000 Btu/lb.

EXAMPLE IV

In an elaboration of Example II using the Constants, above-identified, a copper concentrate is smelted, using the present process, at a rate of 2000 tons concentrate/-day. No supplemental fuel is added to the system during autogenous operation wherein a plurality of parabolic suspensions formed by vertically disposed burners are used for production of a matte that has a copper content of 64%. The Process Fuel Equivalent (PFE) for this operation is calcuated in accordance with the following Table.

TABLE IV

Oxygen Sprinkle Smelting in Converted Reverberatory Furnace

PROCESS: AUTOGENOUS - SUSPENDED BASIC ROOF

| | | | |
|---|---|---|---|
| Smelting Rate | = 2000 tons conc./day | Air Preheat | = none |
| Fuel Rate | = 0 Btu/ton conc. | 98% Oxygen Used | 4950 SCF/ton conc. |
| Matte Grade | = 64% Cu | 33% Oxygen Used | = 0 SCF/ton conc. |
| OUE | = 94% | Tons Acid Rec./ton anode | = 3.1 |
| | | Tons conc./ton anode | = 3.4 |

| Item | Per Ton Anode Copper | | |
|---|---|---|---|
| | Amount | Unit Energy | $10^6$ Btu |
| 1. Smelting: | | | |
| (a) Drying of charge | 3.8 ton | 412000 Btu/ton | 1.55 |
| (b) Gas handling & dust collection | 38300 SCF | 2.5 Btu/SCF | 0.1 |
| (c) Production of oxygen | 17200 SCF | 170 Btu/SCF | 2.9 |
| (d) Drying of flux | 0.5 ton | 412000 Btu/ton | 0.2 |
| (e) Flux for smelting | 0.5 ton | 100000 Btu/ton | 0.05 |
| (f) Milling of smelter slag | 1.8 ton | 770000 Btu/ton | 1.4 |
| (g) Steam credit, power generated | 98 KWH | 10500 Btu/KWH | −1.05 |
| (h) Coal | 0 ton | $24 \times 10^6$ Btu/ton | 0 |
| 2. Converting: | | | |
| (a) Total energy input | 1.04 ton blister | $1.3 \times 10^6$ Btu/ton | 1.35 |
| (b) Steam credit, power generated | 71 KWH | 10500 Btu/KWH | −0.75 |
| (c) Milling of converter slag | 0.5 ton | 770000 Btu/ton | 0.4 |
| 3. Anode Production | 1.0 ton | $1.35 \times 10^6$ Btu/ton | 1.35 |
| 4. Miscellaneous | 48 KWH | 10500 Btu/KWH | 0.5 |
| 5. Acid Mfg.: | | | |
| (a) Smelter gas: (42% $SO_2$) | 150 KWH | 10500 Btu/KWH | 1.6 |
| (b) Converter gas (9% $SO_2$) | 85 KWH | 10500 Btu/KWH | 0.9 |
| | | TOTAL | 10.5 |

PFE = $10.5 \times 10^6$ Btu/ton anode copper
= $2.9 \times 10^6$ Kcal/tonne anode copper

EXAMPLE V

An example is carried out, using the Constants previously described except that furnace heat loss rate is 377,000 BTU/min. and air infiltration rate is 2500 scfm, wherein a controlled amount of pyrite and coal is added to the concentrate which is injected into the hot atmosphere through the burner positioned closest to the slag discharge end of the furnace. The copper concentrate is smelted at a rate of 1500 tons concentrate/day. Injection of concentrate and flux is effected through the first two burners spaced along the roof of the furnace, whereas 150 tons/day of barren pyrite and 36 tons/day of coal are added to the concentrate injected through the third burner. The matte produced has a copper content of 42% and the Process Fuel Equivalent (PFE) for this operation is calculated in accordance with the following Table.

TABLE V

Oxygen Sprinkle Smelting in Converted Reverberatory Furnace

PROCESS: WITH SLAG CLEANING - SPRUNG SILICA ROOF

| | | | |
|---|---|---|---|
| Smelting Rate: | = 1500 tons conc./day | Air Preheat: | = none |
| Fuel Rate: | = $0.6 \times 10^6$ BTU/ton conc. | 98% Oxygen Used: | = 3380 SCF/ton conc. |
| Matte Grade: | = 42% Cu | 33% Oxygen Used: | = 5500 SCF/ton conc. |
| OUE: | = 97.7% | Tons Acid Rec./ton anode: | = 3.7 |
| | | Tons conc./ton anode: | = 3.4 |

| Item | Per Ton Anode Copper | | |
|---|---|---|---|
| | Amount | Unit Energy | $10^6$ Btu |
| 1. Smelting: | | | |
| (a) Drying of charge | 3.8 ton | 412000 Btu/ton | 1.55 |
| (b) Gas handling & dust collection | 39200 SCF | 2.5 Btu/SCF | 0.1 |
| (c) Production of oxygen | 14600 SCF | 170 Btu/SCF | 2.48 |
| (d) Drying of flux | 0.23 ton | 412000 Btu/ton | 0.1 |
| (e) Flux for smelting | 0.23 ton | 100000 Btu/ton | .02 |
| (f) Steam credit, power generated | 112 KWH | 10500 Btu/KWH | −1.2 |
| (g) Coal | 0.08 ton | $24 \times 10^6$ Btu/ton | 1.9 |
| 2. Converting: | | | |
| (a) Total energy input | 1.04 ton blister | $2.3 \times 10^6$ Btu/ton | 2.4 |
| (b) Steam credit, power generated | 133 KWH | 10500 Btu/KWH | −1.4 |
| 3. Anode production | 1.0 ton | $1.35 \times 10^6$ Btu/ton | 1.35 |
| 4. Miscellaneous | 48 KWH | 10500 Btu/KWH | 0.5 |
| 5. Acid Mfg.: | | | |
| (a) Smelter Gas (33% $SO_2$) | 153 KWH | 10500 Btu/KWH | 1.6 |
| (b) Converter gas: (8% $SO_2$) | 183 KWH | 10500 Btu/KWH | 1.9 |
| | | TOTAL | 11.3 |

PFE = $11.3 \times 10^6$ Btu/ton anode copper
= $3.1 \times 10^6$ Kcal/tonne anode copper It will be understood by those skilled in the art that cobaltiferous nickel sulfide concentrates can also be readily treated in accordance with the teachings of the present invention. For example, a pentlandite concentrate analyzing 10% Ni, 0.4% Co, 35% Fe, 30% S and 17% $SiO_2$ can be oxygen sprinkle smelted to yield a matte and slag analyzing 45% Ni, 1.4% Co, 22% Fe, and 0.20% Ni, 0.10% Co respectively, and 30% $SO_2$ in the furnace off-gas. Pyrrhotite and coal are employed for slag cleaning purposes.

By use of the present process, wherein sulfide concentrate, flux, and an oxygen-rich gas are injected into a hot sulfur dioxide-rich atmosphere of a modified reverberatory furnace as a plurality of paraboloidal suspensions, existing reverberatory furnaces are transformed into oxygen sprinkle smelting furnaces and thereby are given an extension of useful life. The main capital requirements therefor involve installation of concentrate drying, oxygen generating and sulfur fixation facilities, all of which will be required for the efficient pyrometallurgical continuous oxygen technology of the future. The process may be operated autogenously or a small amount of coal may be added to the charge for heating purposes. Supplemental burners may also be used in addition to the burners injecting the solids as paraboloidal suspensions. The paraboloidal suspensions must, however, provide for substantially uniform heat and mass distribution throughout a major portion of the horizontal refractory enclosure in order to achieve the desired results.

We claim:

1. In the method for producing a metal matte from a nonferrous metal-containing sulfide mineral concentrate in a horizontal reverberatory furnace wherein a molten charge of metal matte and a slag are present, beneath an enclosed hot atmosphere, and exhaust gases, metal matte and slag are separately discharged therefrom, the improvement comprising:

sprinkling a mixture of said sulfide concentrate, flux and an oxygen-rich gas into an enclosed hot sulfur dioxiderich atmosphere so as to effect oxidation of the sulfide concentrates therein prior to contact of said concentrates with the molten slag; a major portion of said sulfide concentrate, flux and oxygen-rich gas mixture being injected through a plurality of vertically disposed burners on said furnace into said enclosed sulfur dioxide-rich hot atmosphere as a plurality of paraboloidal suspensions, so as to effect substantially uniform heat and mass distribution over a major portion of said horizontal furnace.

2. In the method for producing a metal matte from a nonferrous metal-containing sulfide mineral concentrate as defined in claim 1, the improvement wherein said nonferrous metal is selected from the group comprising copper, nickel, cobalt and mixtures thereof.

3. In the method for producing a metal matte from a nonferrous metal-containing sulfide mineral concentrate as defined in claim 2, the improvement wherein said oxygen-rich gas contains between 80 and 99.5% oxygen.

4. In the method for producing a metal matte from a nonferrous metal-containing sulfide mineral concentrate as defined in claim 1, the improvement wherein said oxygen-rich gas contains between 33% and 99.5% oxygen and wherein said mixture is injected radially downward by means of the vertically disposed burners into said enclosed hot sulfur dioxide-rich atmosphere in the form of paraboloidal suspensions and the horizontal spreading velocity of said suspensions upon said injection is greater than the vertical axial velocity thereof.

5. In the method for producing a metal matte from a nonferrous metal-containing sulfide mineral concentrate as defined in claim 4, the improvement wherein said plurality of suspensions form a substantially oblate-shaped pattern upon contact of the same with said slag.

6. In the method for producing a metal matte from a nonferrous metal-containing sulfide mineral concentrate as defined in claim 5, the improvement wherein said substantially oblate-shaped pattern, upon contact with the slag, is in the form of a pattern of broad contiguous ovals.

7. In the method for producing a metal matte from a nonferrous metal-containing sulfide mineral concentrate as defined in claim 1, the improvement wherein said nonferrous metal is selected from the group comprising copper, cobaltiferous copper, cobaltiferous nickel, and cobaltiferous copper-nickel.

8. In the method for producing a metal matte from a nonferrous metal-containing sulfide mineral concentrate as defined in claim 2, the improvement wherein a minor amount of coal is intimately admixed with said concentrate prior to injection thereof into said hot atmosphere.

9. In the method for producing a metal matte from a nonferrous metal-containing sulfide mineral concentrate as defined in claim 8, the improvement wherein a plurality of said suspensions are vertically directed along the length of the furnace and wherein a minor amount of coal is added to a portion of said concentrate for injection as the suspension injected closest to the slag discharge end of said furnace, said coal being added in amount sufficient to melt said concentrate under substantially nonoxidizing conditions.

10. In the method for producing a metal matte from a nonferrous metal-containing sulfide mineral concentrate as defined in claim 9, the improvement wherein the concentrate injected closest to the slag discharge end is an iron sulfide.

11. In the method for producing a metal matte from a nonferrous metal-containing sulfide mineral concentrate as defined in claim 8, the improvement wherein said oxygen-rich gas contains at least 33% oxygen.

12. In the method for producing a metal matte from a nonferrous metal-containing sulfide mineral concentrate as defined in claim 1, the improvement wherein said method is operated autogenously.

13. In the method for producing a metal matte from a nonferrous metal-containing sulfide mineral concentrate as defined in claim 1, the improvement wherein said exhaust gases contain at least 20% by volume of sulfur dioxide.

14. In the method for producing a metal matte from a nonferrous metal-containing sulfide mineral concentrate as defined in claim 1, the improvement wherein said metal matte contains less than 30% iron and said slag contains less than 3% of the total value metal in the dry solid charge.

* * * * *